US011180224B2

(12) United States Patent
Weisenburger

(10) Patent No.: US 11,180,224 B2
(45) Date of Patent: Nov. 23, 2021

(54) SURFBOARD WITH HANDLE

(71) Applicant: WBV Weisenburger Bau+Verwaltung GMBH, Rastatt (DE)

(72) Inventor: Nicolai Weisenburger, Baden-Baden (DE)

(73) Assignee: WBV Weisenburger Bau+Verwaltung GmbH, Rastatt (DE)

( * ) Notice: Subject to any disclaimer, the term of this patent is extended or adjusted under 35 U.S.C. 154(b) by 0 days.

(21) Appl. No.: 16/956,560

(22) PCT Filed: Dec. 20, 2018

(86) PCT No.: PCT/EP2018/086292
§ 371 (c)(1),
(2) Date: Jun. 20, 2020

(87) PCT Pub. No.: WO2019/122185
PCT Pub. Date: Jun. 27, 2019

(65) Prior Publication Data

US 2021/0147041 A1 May 20, 2021

(30) Foreign Application Priority Data

Dec. 21, 2017 (DE) ..... 102017130949.7

(51) Int. Cl.
*B63B 32/10* (2020.01)
*B63B 32/70* (2020.01)
*B63H 11/08* (2006.01)

(52) U.S. Cl.
CPC ..... *B63B 32/10* (2020.02); *B63B 32/70* (2020.02); *B63H 11/08* (2013.01); *B63H 2011/081* (2013.01)

(58) Field of Classification Search
CPC ..... B63H 32/10; B63H 32/70; B63H 11/08; B63H 2011/081; B63B 32/10; B63B 32/70
See application file for complete search history.

(56) References Cited

U.S. PATENT DOCUMENTS 6,192,817 B1 2/2001 Dec
7,207,282 B1 * 4/2007 Ruan ..... B63B 35/665 114/55.56
7,272,997 B1 * 9/2007 Lee ..... B25B 13/56 81/177.1

(Continued)

FOREIGN PATENT DOCUMENTS

GB 1548892 A 7/1979
KR 101767476 B1 8/2017

*Primary Examiner* — Stephen P Avila
(74) *Attorney, Agent, or Firm* — Bay State IP, LLC

(57) ABSTRACT

A surfboard with a deck (17), an electric drive for the surfboard (2), wherein one end of a rope (7) is fastened to the bow (4) of the surfboard (2) and another end of the rope (7) has a handle (8), wherein the drive is connected to a controller (21), which comprises a receiver (25) of a wireless remote control, and the handle (8) has an accelerator lever (23) which is connected to a transmitter (24) of the wireless remote control in a data conducting manner, and the transmitter (24) is arranged in the handle (8), and by actuation of the accelerator lever (23) control signals can be generated, which can be transmitted by the transmitter (24) as wireless signals and can be received by the receiver (25) and can be converted by the controller (21) into control values for the drive.

15 Claims, 5 Drawing Sheets

(56) References Cited

U.S. PATENT DOCUMENTS

Figure 1:
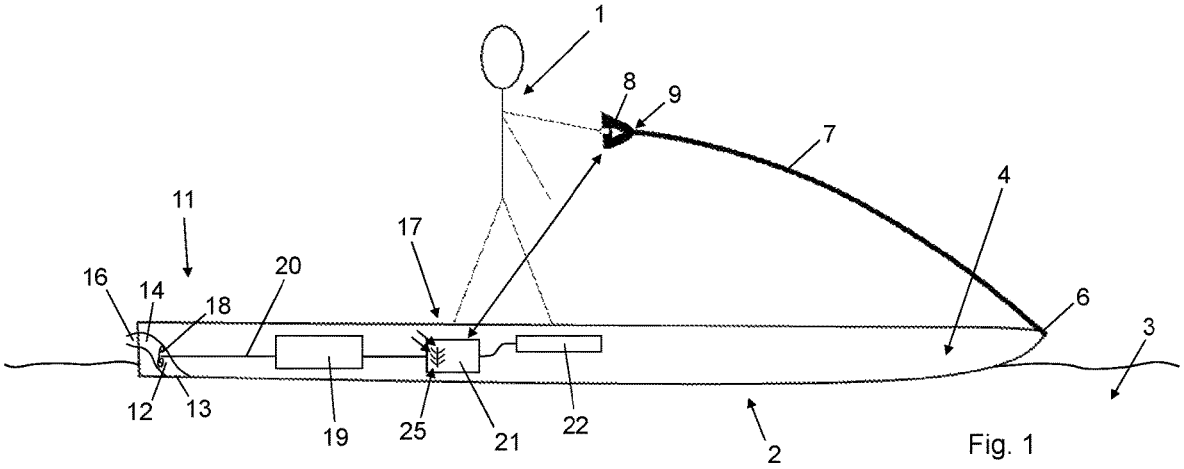

| | | | | |
|---|---|---|---|---|
| 9,359,044 | B2 * | 6/2016 | Langelaan | B63B 32/60 |
| 2003/0043053 | A1 * | 3/2003 | Schuckel | G08C 19/22 340/13.25 |
| 2013/0165299 | A1 * | 6/2013 | Hunt | A63B 5/20 482/82 |

* cited by examiner

SURFBOARD WITH HANDLE

CROSS REFERENCE TO RELATED APPLICATION

This application is for entry into the U.S. National Phase under § 371 for International Application No. PCT/EP2018/086292 having an international filing date of Dec. 20, 2018, and from which priority is claimed under all applicable sections of Title 35 of the United States Code including, but not limited to, Sections 120, 363, and 365(*c*) and which in turn claims priority under 35 USC 119 to German Patent Application No. 102017130949.7 filed on Dec. 21, 2017.

The invention relates to a surfboard with a deck and a drive for the surfboard, wherein one end of a rope is fastened to the bow of the surfboard and another end of the rope has a handle.

Naturally, surfboards are well known. In English language usage, surfboards are boards which do not have a sail and on which a surfer can ride, powered by a wave. The German word for surfing translates as "riding the waves".

The surfboard according to the invention relates to this type of sport. The surfer stands on the surfboard and preferably travels over the water without propulsion caused by a sail or waves.

US2002/0056408 A1 discloses a surfboard having an accelerator cable with a handle at one end for the surfer. The other end of the accelerator cable is fastened to the bow of the surfboard and is connected to a combustion engine.

U.S. Pat. No. 6,192,817 B1 discloses a surfboard with a combustion engine and an accelerator lever associated with an accelerator cable.

U.S. Pat. No. 3,324,822 likewise relates to a surfboard having an accelerator lever and an accelerator cable which controls the forward propulsion of a combustion engine.

DE 20 2011 051 071 U1 relates to a surfboard having an electric drive and a wireless connection. A hand-held controller comprises a gyroscope function.

The surfboard has a drive for this purpose. Surfboards with an electric drive are known for example from DE 20 2011 051 071. Powered surfboards are not dependent on a heavy swell, but can also be used in bodies of water which are windless and have little surf. The surfer also does not need to stand up on the surfboard to paddle, since the propulsion is obtained by the drive.

The control of the forward propulsion by the surfer has proved problematic.

Therefore it is an object of the invention to provide a surfboard which at least reduces the above-mentioned disadvantage.

This object is achieved by a surfboard referred to in the introduction with the features of claim 1.

The surfboard according to the invention has an electric drive, preferably in the rear region of the surfboard; this is preferably a jet drive. The jet drive has an opening on the underwater surface of the surfboard as well as a water channel which runs from the underwater surface to a nozzle on the rear end face of the surfboard. The nozzle can be designed to be pivotable or non-pivotable. A rotor is provided in the water channel. A rotor is understood to be both a propeller and also an impeller. In this case due to the high speed of the rotor water is drawn into the water channel and sprayed out of the nozzle towards the stern against the direction of travel, so that the surfboard is given the necessary forward propulsion. The rotor is connected by means of a drive train to an electric motor which is supplied with power via a preferably replaceable battery. Furthermore, according to the invention the motor is preferably electrically conductively connected to a controller which transmits control signals to the motor and thus controls the output of the drive, that is to say the speed of the surfboard. The controller receives the necessary control signals via a preferably hand-held remote control.

The surfboard preferably has an inflatable hull part and a drive unit. The hull part can also be manufactured from a drop-stitch material. The inflated hull part has a recess at the stern into which the drive unit can be releasably inserted. However, the surfboard can also consist of a continuously solid hull made from a non-inflatable material. A drive for the surfboard, preferably a jet drive, is provided in the drive unit or in the interior of the hull.

According to the invention the controller is connected to a receiver in a signal-conducting manner, and the receiver receives the signals from the transmitter of a wireless remote control. A handle has an accelerator lever which is operatively connected to a transmitter of the wireless remote control. The transmitter is arranged in the handle, and electrical signals are generated by actuation of the accelerator lever and are sent to the transmitter, which converts them into wireless signals which can be received by the receiver and can be converted by the controller into control signals for the drive.

A wireless connection naturally has the advantage over a cable connection that no cables which could disturb the surfer are present and no holes are necessary in the hull for plug connections.

According to the invention the handle is connected to the surfboard by means of a rope. One end of the rope is fastened to the bow and another end of the rope is releasably connected to the handle. Thus the surfboard has two different types of construction. The rope connected to the handle and board in the first type of construction advantageously enables the surfer to keep his balance more easily. By the detachment of the handle from the rope it is possible in the second type of construction to make the surfing freer and more difficult for the surfer, as he has no pulling connection to the surfboard but holds the handle with the remote control freely in one hand and must keep his balance without a rope.

Advantageously one end of the rope can be releasably connected to the bow. By detachment of both ends it is possible to dispense with the rope completely, and it can be left on land while the sport is being carried out.

The control of the surfboard is advantageously kept very easy to manipulate.

The remote control preferably comprises a wireless remote control. The wireless remote control is a commercially available wireless remote control, which can therefore be obtained cost-effectively and has proven itself.

Wireless remote controls which transmit wireless signals by pulse modulation in the ISM band have proven particularly reliable in the transmission of control values. By contrast with amplitude modulation, pulse modulation is less susceptible to malfunction in wireless signal transmission. The transmission of the radio signals advantageously takes place in the 2.4 to 2.5 GHz ISM band. In principle other ISM bands are also conceivable for transmission of the wireless signals.

The handle preferably has a gripping portion for the surfer to grip with one hand, wherein a centre of force is arranged centrally in the gripping portion.

While carrying on the sport the surfer stands on the deck of the surfboard, and gripping the handle of the rope fastened to the bow can help the surfer to keep his balance. In this case he can exert a considerable force on the rope and the bow, a force which can correspond to his body weight or a multiple of his body weight during short force peaks.

One end of the rope is preferably fastened by a fastening means to the bow of the surfboard and/or the other end of the rope is connected by a further fastening means to the handle. Thus one end of the rope can be permanently or releasably fastened to the bow and the rope can be permanently or releasably fastened by the other end to the handle.

The fastening means and the further fastening means are preferably releasable without tools. Advantageously the fastening means and/or the further fastening means has a snap closure, such that the handles can be easily replaced and the rope and handle can be removed from the bow of the surfboard, and also the handle can be used purely as a remote control without the rope. The latter has the advantage that a trained surfer who does not need the rope in order to keep his balance can use the handle as a wireless remote control, and then there is no rope present which could cause disturbance for the surfer. A knot can also be provided in each case as the fastening means and/or further fastening means.

The further fastening means for the other end of the rope is preferably arranged spaced apart perpendicularly from the gripping portion and at the centre of the gripping portion. By gripping of the gripping portion, during pulling a centre of force is produced centrally in the gripping portion, so that no torques act on the wrist and the surfer can also hold the handle for longer.

The accelerator lever is arranged in the handle in such a way that the surfer can actuate the accelerator lever with the one hand by which he holds the handle, and generates control values correlating with the position of the accelerator lever.

Advantageously, by firmly holding the handle the surfer can on the one hand keep his balance well on the surfboard and on the other hand can also accelerate at the same time using the same hand.

The handle is preferably watertight, since the surfer can also fall off of the board, so that the handle then falls into the water. For this reason the handle preferably also has an average density of $\rho<1$ g/cm$^3$, so that it floats on the water.

The handle is preferably triangular with rounded corners along its outer periphery and in the interior is likewise substantially triangular, wherein the gripping portion is preferably ergonomically designed. Various shapes for the handle are conceivable, for example also semi-circular, circular, oval shapes, etc.

In a first embodiment of the invention the accelerator lever is designed as a push button which can be recessed in the gripping portion. In this case the push button can preferably be operated by means of the forefinger.

In a second embodiment of the invention the drive control has a movably arranged accelerator lever which can be actuated externally on the handle by the surfer's thumb. The accelerator lever can be arranged pivotably about an axis and can have a pressure surface which, when the gripping portion is gripped naturally, is placed in front of the thumb.

In a third embodiment the accelerator lever is arranged internally in the handle. In this case the accelerator lever can advantageously be operated with the surfer's forefinger or middle finger.

The invention is described with reference to three exemplary embodiments in seven drawings. In the drawings:

FIG. 1 shows a schematic view of a surfboard according to the invention with a drive control according to the invention in the handle.

Figure 2B:
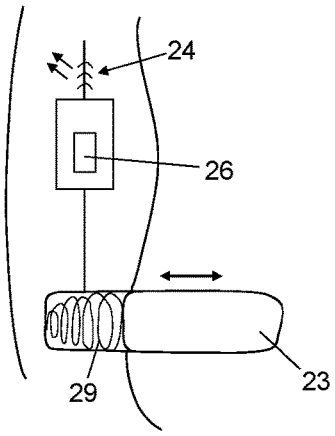
Figure 2A:
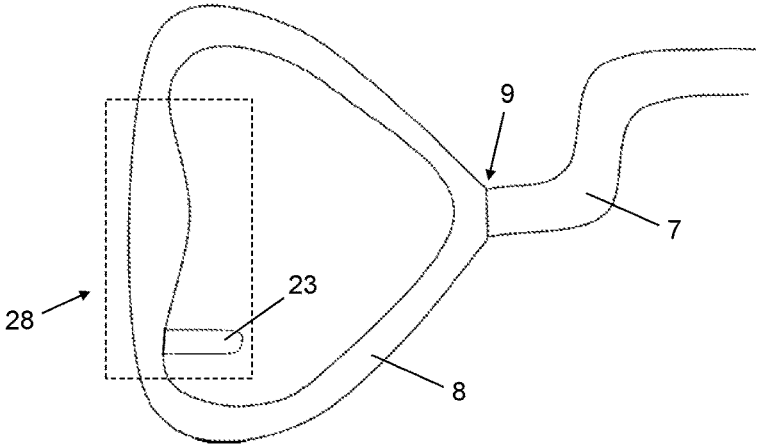
Figure 3B:
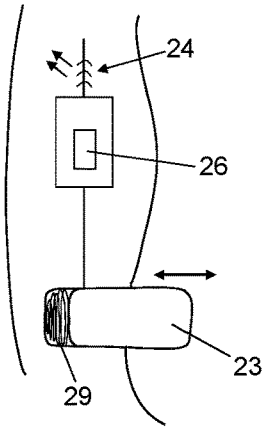
Figure 3A:
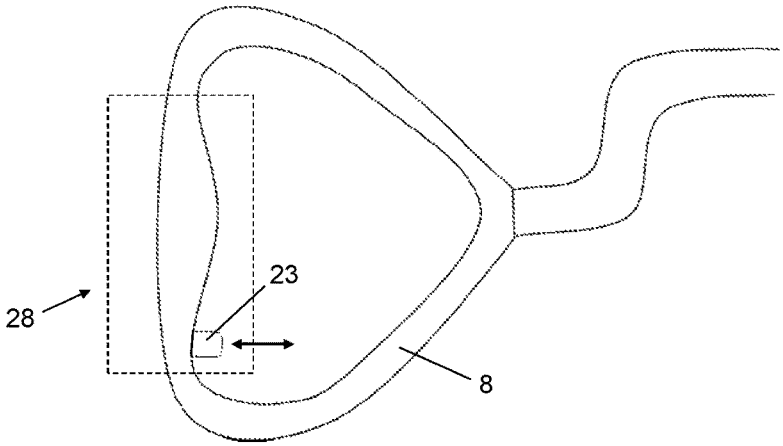
Figure 4:
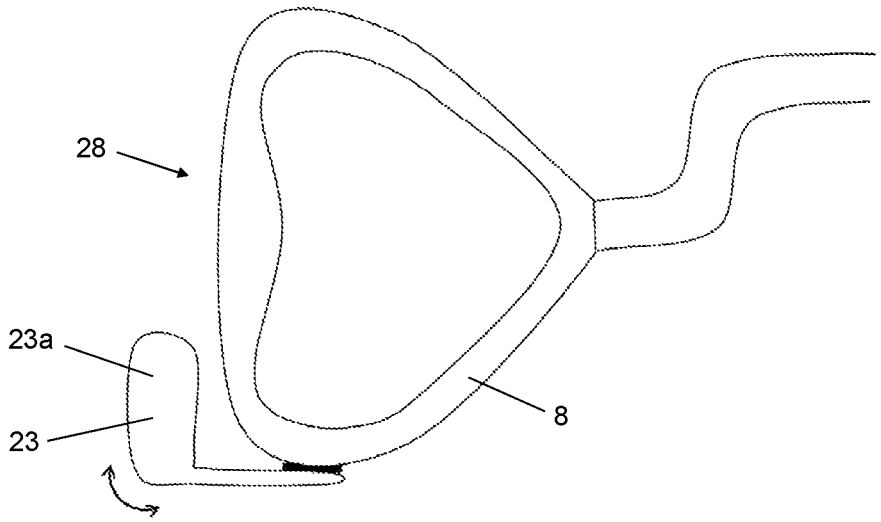
Figure 5:
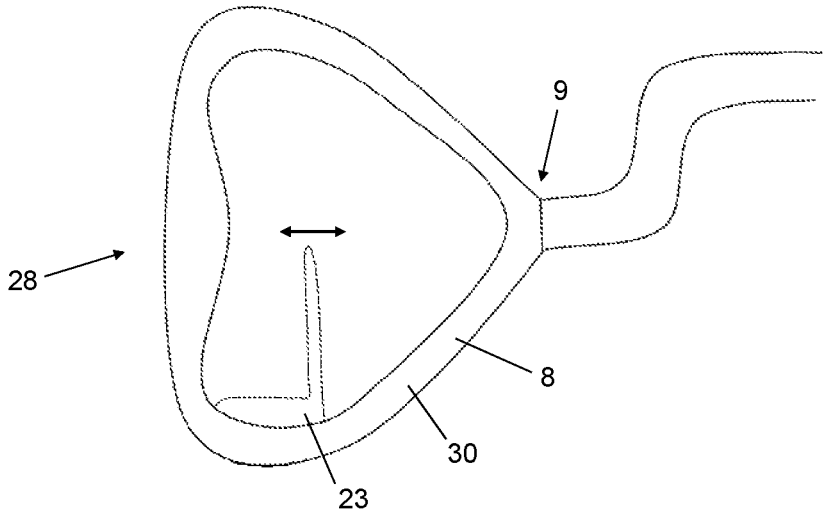

FIG. 2*a* shows a handle in a first embodiment of the accelerator lever in a neutral position, FIG. 2*b* shows a detail of FIG. 2*a*, FIG. 3*a* shows a handle in the first embodiment of the accelerator lever in an acceleration position, FIG. 3*b* shows a view of a detail in FIG. 3*a*, FIG. 4 shows a handle with a second embodiment of a drive control, FIG. 5 shows a handle with a third embodiment of a drive control.

FIG. 1 shows a surfer 1 on the surfboard 2 according to the invention while carrying on the sport. In principle, a surfboard is to be understood as a device on which the surfer 1 stands, kneels or sits and which floats on water 3 and ideally has sufficient buoyancy to support the surfer 1. Where appropriate, the buoyancy can be chosen to be only so great that, together with the forward propulsion of a drive, it is sufficient to support the surfer.

The surfboard 2 has no sail; in the German language usage the sport would be classified as riding the waves.

The surfboard 2 comprises a bow 4, to which the rope 7 is fastened with a preferably releasable fastening means 6. On the other end of the rope 7 a handle 8 is fastened to the rope 7 with a preferably releasable fastening means 9.

The surfboard 2 has a jet drive 12 at the 11. The jet drive 12 is only illustrated schematically here. The jet drive 12 comprises an opening 13 as water inlet in an underwater surface of the surfboard 2 and a water channel 14 with a water outlet arranged on an end face of the stern 11. The water outlet is designed as a nozzle 16 which, where appropriate, is pivotably rotatable about an axis of rotation arranged vertically with respect to a deck 17. In the water channel 14 a rotor 18 is arranged, by which the water penetrating into the water channel 14 due to the weight of the surfer 1 is sprayed out of the nozzle 16, thereby providing propulsion for the surfer 1 with the surfboard 2. In a hull of the surfboard 2 a motor 19 for the rotor 18 is arranged which drives the rotor 18 by means of a drive train 20, and also arranged there is a controller 21 for the motor 19, by which an output of the motor 19 can be controlled and, in particular the speed of the surfboard 2 can be controlled thereby. Both the motor 19 and also the controller 21 are supplied with power by means of a battery 22.

During surfing the surfer 1 grips the handle 8 of the surfboard 2 with one hand. It has been shown that as a result it is significantly easier for the surfer 1 to keep his balance on the surfboard 2, even while riding at relatively high speed round a curve and riding over waves. The handle 8 is connected to the releasable further fastening means 9 by the other end of the rope. The releasable further fastening means 9 may be, like the fastening means 6, a closure which can be opened without tools, in particular a snap closure or the like. An accelerator lever 23 which is integrated in the handle 8 can be operated with one finger or a plurality of fingers and controls a transmitter 24 of a remote control in the handle 8. The transmitter 24 interacts with a receiver 25 arranged on the controller 21 and together they form the remote control. A rechargeable battery 26 can be arranged in the transmitter 24 if required. In the case according to the invention the remote control exclusively controls the speed of the surfboard 2. Steering movements to right and left are achieved here by shifting the weight of the surfer 1.

The handle 8 according to the invention must, on the one hand, perform the function that the surfer 1 can hold it firmly with considerable force and that in particular torques occur on the wrist joint of the surfer 1. On the other hand, while the handle is gripped it must be possible to operate the accelerator lever 23 easily.

FIG. 2*a* and FIG. 3*a* show the handle 8 according to the invention which in its outer and inner periphery is approximately triangular with rounded corners and an ergonomically shaped gripping portion 28. The further fastening means 9 for the other end of the rope 7 is provided perpendicularly opposite the gripping portion 28, approximately at the centre of the gripping portion 28. The rope 7 can be knotted with its other end on the handle 8. However, the further fastening means 9 can also be designed as a snap closure or the like. When the handle 8 is gripped with the palm of the hand, the raised inwardly directed region of the gripping portion 28 is clasped by the palm. In the thickest region of the gripping portion 28 the centre of force is formed by the tensile force exerted by the surfer 1. During gripping the forefinger rests on the accelerator lever 23 which in this embodiment is configured as a push button 23. In FIG. 2*a* the push button 23 is illustrated in a raised position, the neutral position, in which no acceleration is provided. In FIG. 3*a* the push button 23 is illustrated in a pressed-in position, the acceleration position. The output of the motor 19 is increased linearly with the insertion depth of the push button 23. Naturally, other functional correlations between insertion depth and motor power are also conceivable. FIG. 3*a* shows the push button 23 pressed in. The hand of the surfer 1 is not illustrated.

The push button 23 has a restoring mechanism, for example a restoring spring 29, which returns it to the neutral position when the handle 8 is released.

A second embodiment of the handle 8 according to the invention is illustrated in FIG. 4. Apart from the accelerator lever 23 the handle 8 is configured as in the first embodiment. There the accelerator lever 23 is arranged pivotably on the outside of the handle 8. The accelerator lever 23 is arranged laterally on the outside of the handle 8. On a region of the gripping portion 28 remote from the other end of the rope, a lever surface 23*a* facing in the direction of the gripping portion 28 is arranged on the accelerator lever 23. The accelerator lever 23 can be operated by pressing the lever surface 23*a*. It can be operated by the thumb of the surfer 1 who grips the handle 8 with his right hand. For surfers who prefer to hold the handle with the left hand, the direction of movement of the lever 23 can be reversed.

FIG. 5 shows a third embodiment of the accelerator lever 23 according to the invention. Here the accelerator lever 23 in turn is arranged in the interior of the handle 8, specifically on a lateral connecting piece 30 between the further fastening means 9 and the gripping portion 28. The accelerator lever 23 is configured as a pivotable accelerator lever 23 which can be pressed by the forefinger of the surfer 1. The accelerator lever 23 carries out a pivoting movement about a centre of rotation in the lateral connecting piece 30.

Also, in the embodiments according to FIG. 4 and FIG. 5, the transmitter 24 (not shown in FIG. 4 and FIG. 5) with the battery 26 is arranged in the gripping portion 28. Only the mechanism for generating the control signals by actuation of the accelerator lever 23 has a different configuration; the electrical connection to the transmitter 24 and the transmitter have the same configurations. In each case one of the restoring springs 29 is also advantageously provided.

LIST OF REFERENCE NUMERALS

1 surfer
2 surfboard
3 water
4 bow
6 fastening means
7 rope
8 handle
9 further fastening means
11 stern
12 jet drive
13 opening
14 water channel
16 nozzle
17 deck
18 rotor
19 motor
20 drive train
21 controller
22 battery
23 accelerator lever/push button
23*a* lever surface
24 transmitter
25 receiver
26 battery
28 gripping portion
29 restoring spring
30 connecting piece

The invention claimed is:

1. A Surfboard comprising:

a deck (17), an electrical drive for the surfboard (2), wherein one end of a rope (7) is fastened to the bow (4) of the surfboard (2) and another end of the rope (7) has a handle (8), the drive is connected to a controller (21), which comprises a receiver (25) of a wireless remote control, and the handle (8) has an accelerator lever (23) which is connected to a transmitter (24) of the wireless remote control in a data conducting manner, and the transmitter (24) is arranged in the handle (8) and by actuation of the accelerator lever (23) control signals can be generated, which can be transmitted by the transmitter (24) as wireless signals and can be received by the receiver (25) and can be converted by the controller (21) into control values for the drive and the one end of the rope (7) can be releasably connected to the bow (4) and the other end of the rope (7) can be releasably fastened to the handle (8) characterized in that the surfboard has two types of construction and the rope is connected to the handle and the surfboard in a first type of construction and rope is detached from the handle and the surfboard in a second type of construction.

2. Surfboard according to claim 1, characterised in that the remote control preferably comprises a wireless remote control.

3. Surfboard according to claim 1, characterised in that the wireless remote control transmits wireless signals by pulse width modulation in an ISM band.

4. Surfboard according to claim 1, characterised in that the transmission of the wireless signals takes place in a 2.4-2.5 GHz ISM band.

5. Surfboard according to claim 1, characterised in that the handle (8) has a gripping portion (28) for the surfer (1) to grip with one hand, and during surfing a centre of force is arranged centrally in the gripping portion (28).

6. Surfboard according to claim 1, characterised in that the handle (8) is watertight.

7. Surfboard according to claim 1, characterised in that the handle (8) has an average density of $\rho<1.0$ g/cm$^3$.

8. Surfboard according to claim 1, characterised in that the accelerator lever (23) is arranged internally in the handle (8).

9. Surfboard according to claim 1, characterised in that internally the accelerator lever (23) is pivotably arranged laterally on a connecting piece (30) between the gripping portion (28) and the fastening means (9).

10. Surfboard according to claim 1, characterised in that the accelerator lever is configured as a push button (23) which can be recessed in the gripping portion (28).

11. Surfboard according to claim 1, characterised in that the drive control includes the accelerator lever (23) which is arranged externally on the handle (8) so that it can be operated by a thumb of the hand of the surfer (1) gripping the handle (8).

12. Surfboard according to claim 1, characterised in that one end of the rope (7) is fastened releasably to the bow (4) by means of a fastening means (6).

13. Surfboard according to claim 1, characterised in that the other end of the rope (7) is fastened releasably to the handle (8) by means of a further fastening means (9).

14. Surfboard according to claim 1, characterised in that the further fastening means (9) for the other end of the rope is arranged spaced apart perpendicularly and centrally from the gripping portion (28).

15. Surfboard according to claim 1, characterised in that the fastening means (6) and/or the further fastening means (9) have a snap closure.

* * * * *